US006279682B1

(12) United States Patent
Feathers

(10) Patent No.: US 6,279,682 B1
(45) Date of Patent: Aug. 28, 2001

(54) SPEED RESPONSIVE COUPLING DEVICE ESPECIALLY FOR FALL ARREST APPARATUS

(75) Inventor: Leonard John Feathers, Clwyd (GB)

(73) Assignee: Sala Group Limited (GB)

( * ) Notice: Subject to any disclaimer, the term of this patent is extended or adjusted under 35 U.S.C. 154(b) by 449 days.

(21) Appl. No.: 08/656,299

(22) PCT Filed: Jan. 13, 1995

(86) PCT No.: PCT/GB95/00067

§ 371 Date: Sep. 9, 1996

§ 102(e) Date: Sep. 9, 1996

(87) PCT Pub. No.: WO95/19203

PCT Pub. Date: Jul. 20, 1995

(30) Foreign Application Priority Data

| | | |
|---|---|---|
| Jan. 13, 1994 | (GB) | 94 005 63 |
| Aug. 18, 1994 | (GB) | 94 167 20 |
| Sep. 7, 1994 | (GB) | 94 179 81 |

(51) Int. Cl.[7] ..... A62B 1/00
(52) U.S. Cl. ..... 182/239
(58) Field of Search ..... 182/237, 236, 182/231, 232, 239; 242/383, 383.4

(56) References Cited

U.S. PATENT DOCUMENTS

| | | | | |
|---|---|---|---|---|
| 3,150,744 | * | 9/1964 | Fertiev | 182/239 |
| 3,442,466 | * | 5/1969 | Fritsche | 242/383 |
| 3,923,269 | * | 12/1975 | Kell | 242/383 |
| 4,511,123 | * | 4/1985 | Ostrobrod | 182/234 |
| 4,538,703 | * | 9/1985 | Ellis | 182/234 |
| 4,589,523 | * | 5/1986 | Olson | 182/239 |
| 4,768,733 | * | 9/1988 | Willey | 242/383 |
| 5,400,868 | * | 3/1995 | Ellis | 182/18 |
| 5,447,280 | * | 9/1995 | Feathers | 182/239 |

FOREIGN PATENT DOCUMENTS

| | | | |
|---|---|---|---|
| 9308788 | | 8/1993 | (DE) . |
| 1270109 | | 12/1961 | (FR) . |
| 999552 | | 7/1965 | (GB) . |
| 1282577 | * | 7/1972 | (GB) 242/383 |

* cited by examiner

*Primary Examiner*—Alvin Chin-Shue
(74) *Attorney, Agent, or Firm*—Mau & Krull, P.A.

(57) ABSTRACT

A speed responsive coupling device for locking a first member with respect to a second against relative rotation in at least one direction, which device comprises a ratchet wheel carried by said first member which is engageable by a pawl carried by the second member, and in which the pawl is arranged as a mechanical toggle switch which is biased to flip between a "free" condition in which such relative rotation is permitted and a "lock" condition in which the pawl engages the ratchet wheel to disallow such relative rotation, said pawl being linked to a rocker which is so shaped and disposed that when the pawl is in the free condition, such relative rotation causes the rocker to rock and that when the speed of such relative rotation exceeds a threshold value, the strength of the rocking motion imparted causes the rocker to flip the pawl to the lock condition.

26 Claims, 5 Drawing Sheets

SPEED RESPONSIVE COUPLING DEVICE ESPECIALLY FOR FALL ARREST APPARATUS

Figure 1:
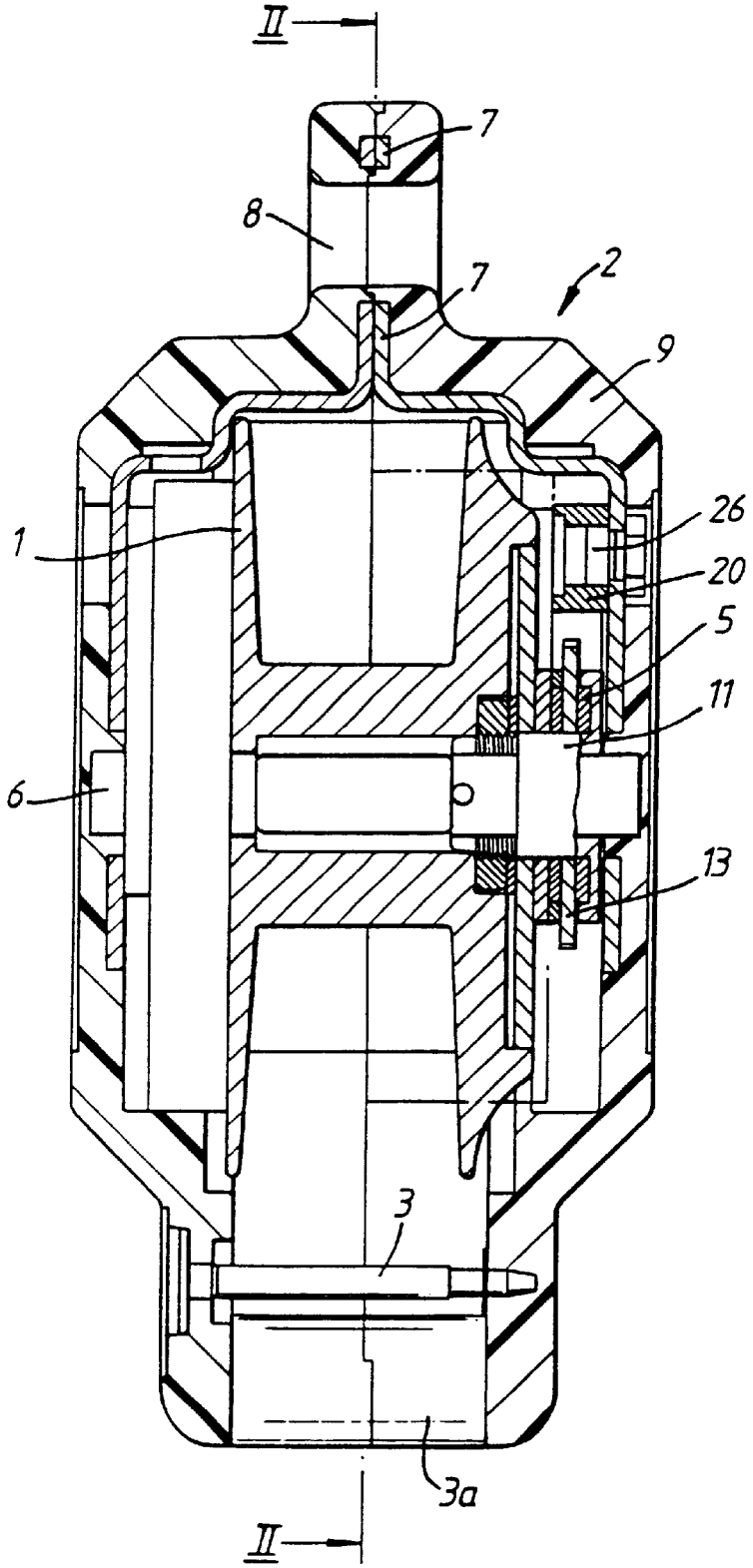

This invention relates to a speed responsive coupling device for locking a first member with respect to a second against relative rotation in at least one direction.

This invention was made with particular reference to the use of such devices in fall arrest apparatus comprising an anchor member and a rotatable drum on which is wound a safety line, and although such devices may be used in various other kinds of apparatus, the invention will be described with special reference to its use in connection with fall arrest apparatus.

Such fall arrest apparatus is required for protecting a worker who is exposed to risk of injury due to a fall from an elevated position at a work place which may typically be a construction site for example of a high-rise building. The anchor member is made fast to a high point on a fixed structure and the safety line wound onto the drum is attached to a body harness with which the worker is equipped. The safety line may be paid out by unwinding from the drum in order to enable the worker to carry out his designated tasks without undue restriction. However, the length of maximum pay-out is often limited so as to limit risk in the event of a fall; having regard to such considerations a maximum pay-out length of say 6 meters can be regarded as typical. It is usual that line payout of this order be controlled by a spring which urges rotation of the drum relative to the anchor member in order to re-wind the safety line.

There is clearly a requirement to brake or prevent any sudden and rapid payout of the safety line in the event of a fall by the worker. This is accomplished by the use of a speed responsive coupling device which in effect locks the drum to the anchor member when the speed of rotation of the drum reaches a threshold value. In order that the arrest of the worker's fall be not too abrupt—which might in itself be the cause of injury—it is usual to associate the coupling device with a brake which acts to slow rotation of the drum in relation to the anchor member, though some other form of shock absorber may be used, or reliance may be had on any inherent elasticity of the safety line.

Speed responsive coupling devices for this and other purposes have been known for many years and have hitherto often comprised pawl and ratchet mechanisms which are brought into locking engagement by means of the centrifugal effect. Such known centrifugal clutch mechanisms commonly comprise at least one spring loaded pivotal pawl carried to rotate with the drum, and when the speed of rotation of the drum reaches a rate corresponding to that occasioned by the fall of a worker attached to a safety line wound onto the drum, a part of the pawl flies out under centrifugal force and this is effective to bring an operative nose of the pawl into engagement with a fixed stop which is usually in the form of a ratchet tooth.

We have found that there is a problem in regard to the reliability of the response of known speed responsive centrifugal clutches to the onset of sudden and rapid payout of safety line as is occasioned by a fall. Such response may be affected by the orientation or attitude of the clutch and drum assembly, and it may also be affected by temperature or by the effects of dirt or corrosion: it will be appreciated that such apparatus is commonly used out of doors. The pawls of centrifugal clutch mechanisms are often restrained by leaf springs and these may become stiffer in very cold weather and thus less reliable just when the risk of a worker falling may be greatest because of possible ice formation at the work place and because of reduced dexterity normally associated with cold weather. There is also a risk that ice may form within the clutch mechanism to prevent its operation.

It is an object of this invention to provide a speed responsive coupling device for locking a first member with respect to a second against relative rotation in at least one direction in which at least some of these disadvantages are alleviated.

In particular it is desired to avoid making use of the centrifugal effect in the operation of the speed responsive coupling device provided according to this invention.

According to this invention, there is provided a speed responsive coupling device for locking a first member with respect to a second against relative rotation in at least one direction, which device comprises a ratchet wheel carried by said first member which is engageable by a pawl carried by the second member, characterised in that said pawl is arranged as a mechanical toggle switch which is biased to flip between a "free" condition in which such relative rotation is permitted and a "lock" condition in which the pawl engages the ratchet wheel to disallow such relative rotation, said pawl being linked to a rocker which is so shaped and disposed that when the pawl is in the free condition, such relative rotation causes the rocker to rock and that when the speed of such relative rotation exceeds a threshold value, the strength of the rocking motion imparted causes the rocker to flip the pawl to the lock condition.

Such a device can be of very simple construction, and we have found that devices according to the invention also tend to be more reliable in operation than coupling devices of comparable cost based on the use of a centrifugal clutch.

In particular, having especial regard to the use of such a device in fall arrest apparatus, the reliability of operation of such a device is substantially independent of its orientation or attitude and it is not significantly affected by temperature variations over the range to be expected in acceptable human working environments. In particular, it may be noted that the pawl members of a centrifugal clutch will, except on the occasion of a fall which one would hope to be a rare event, remain stationary with respect to neighbouring parts of the clutch and are thus susceptible to partial seizing for a variety of reasons or to icing up in cold weather: in a device according to the invention, however, the rocker will be continuously moved by rotation of the drum as safety line is paid out or recovered during normal working, and this movement of the rocker and the linked movement of the pawl will reduce the possibility of partial siezure.

It will be noted that in the speed responsive coupling device according to this invention, no use whatso ever is made of the centrifugal effect.

Instead, at the heart of this invention, lies the concept of using a ratchet engaging pawl with the pawl being arranged as a mechanical toggle switch. Such a switch is one in which the switching member, here the pawl, is spring biased to remain in one of two stable or quasi-stable conditions. Switching is effected by causing the switching member, the pawl, to pass through a metastable position between those two conditions, whereupon it will flip over to the other condition. In the instant case, the rocker which is linked to the pawl, and is preferably an integral part of the pawl, rocks as the first member, e.g. the drum on which safety line is wound, rotates. The arrangement is such that during such rotation at speeds below a threshold value, for example corresponding to line withdrawal at rates appropriate to accommodate normal movements of a worker, this rocking is insufficient to push the pawl into or past its metastable state, and thus the pawl remains in the free condition and rotation of the drum is permitted: in case of rotation at speeds above the threshold value, however, the rapidity of the rocking motion imparted gives such momentum and energy to the pawl and rocker that the pawl is carried into its metastable position and then flips over into the lock condition where it engages the ratchet to prevent further rotation.

It will be appreciated that the required rocking motion could be imparted to the rocker in a variety of ways. For example the rocker could be arranged to bear on a cam surface associated with the first member such as a drum. Preferably, the arrangement is such that during such relative rotation, the ratchet wheel bears directly against said rocker and during its rotation the ratchet wheel directly causes the rocking motion. This simplifies construction in that no additional parts are required. Rocking motion is thus imparted as successive teeth of the ratchet wheel bear on the rocker. These teeth may run over a cam surface of the pawl to cause the oscillatory rocking motion In the most preferred embodiments of the invention, said first member comprises a drum on which a line may be wound. It is preferred that said first member and second members are lockable against such relative rotation in one direction only ("the unwinding direction"), and spring means is provided to urge relative rotation of said first and second members in an opposite, winding, direction. Thus in a device incorporated in fall arrest apparatus, there is means for retrieving safety line in the event that a worker moves towards the apparatus. This keeps the line reasonably taut, and has the advantages of limiting the extent of any fall which may occur, and also of avoiding loose loops of line which might trip a worker and thus cause a fall in the first place.

Advantageously, said first and second members are lockable against such relative rotation in one direction only ("the unwinding direction"), and said rocker is so shaped and disposed that when the pawl is in the lock condition, relative rotation in an opposite, winding, direction causes the pawl to flip back to the free condition. In this way, once the speed responsive coupling device of the invention has been activated to couple the two members together following an excessive relative rotational speed, and such rotation has been stopped, any relative rotation in the opposite sense will reset the device.

The drum, when provided, is preferably rotatable with respect to an anchor member by means of which the drum may be anchored to a fixed structure. The drum may advantageously be carried for rotation on a shaft which is supported on a metal stirrup having an anchor point, conveniently in the form of a through hole, by which it may be secured to a fixed anchorage, on for example a building or other civil engineering structure such as a bridge or tower. Alternatively, the anchor member may be constituted as a metal plate which carries a shaft for rotatably mounting the drum. In either such embodiment, the anchor member and drum may be shielded from the elements within a housing, for example constructed of plastics or other material which is preferably weatherproof and also has dielectric properties: such a housing need not be constructed as a load-bearing member since the loads to be encountered in the event of a fall would be taken up by the metal anchor member. Alternatively, the anchor member could be constituted as a load-bearing housing member.

Brake means may be interposed between the drum and the anchor member. Or in another arrangement there are no brake means; but instead there is inseparably incorporated in the safety line a shock energy absorbing device.

In one preferred embodiment of the invention which incorporates braking means, said pawl and ratchet are operable to lock said drum against rotation relative to a braking member which is in braking engagement with said anchor member. In such embodiments, as the pawl engages, the brake assembly will operate so that frictional forces are set up between the anchor member and the drum so that the rotation of the drum relative to the anchor member is either first retarded and then brought to rest, or so that the rotation of the drum is first retarded and then allowed to continue but at a controlled relatively slow rate.

In other preferred embodiments of the invention, said pawl and ratchet are operable to lock a braking member which is in braking engagement with said drum against rotation relative to said anchor member. In embodiments having this feature, the brake assembly as such is carried by the drum, and a member of the brake assembly is locked to the anchor member as the pawl engages. In either such embodiment, the brake acts to slow rotation of the drum in relation to the anchor member, so that a worker's fall may be brought to a smooth and rapid halt.

In other preferred embodiments, said pawl and ratchet are operable to lock said drum against rotation relative to said anchor member. In such embodiments, no shock absorbing brake is provided, and reliance is had on some other form of shock absorber such as a tear webbing strip or on the inherent elasticity of the safety line.

The invention extends to fall arrest apparatus comprising an anchor member and a rotatable drum on which is wound a safety line, characterised in that a speed responsive coupling device as herein defined is provided for locking said drum against rotation in a line unwinding direction in the event that said line is being stripped from said drum at a rate which is greater than a threshold value.

This invention also extends to fall arrest apparatus comprising a line drum supported by a shaft for rotation relative to a rigid plate member adapted to be secured to a fixed anchorage, a safety line wound on the drum and which can be paid out with the drum unwinding against the influence of a rewind coil spring, there being, operable between said plate member and said drum, unwind rotational speed sensitive clutch means of the toggle action pawl type as above defined, effective to stop rotation of the drum relative to the rigid plate member when a predetermined speed of drum rotation is reached, and said safety line incorporating at or towards its outboard end, an energy dissipating unit for cushioning shock loads occasioned by the safety line, said energy dissipating unit being so connected in the safety line that it can only be disconnected by such destructive breaking of the connection as to render the connection non-reusable.

In such an arrangement, there are no braking means provided for decelerating the drum as has hitherto been conventional. Accordingly when the clutch means operates, the drum is stopped immediately from further rotation, and no longer is it permitted a degree of further rotation strongly opposed by the friction brake means, as occurs when a braking device is incorporated.

Because the line drum has associated with it no braking means, the cushioning of shock loads is performed exclusively by the energy dissipating unit inseparably incorporated in the safety line, coupled with a small element of elastic extensibility in the safety line itself which latter can for all practical purposes be ignored.

The energy dissipating unit is disposed at or near the outboard end of the safety line. It is disposed near the worker and indeed one line of the unit may be clipped directly to the worker's body harness or to a short lanyard forming part of such harness. As the unit is close to the worker it should encumber him as little as possible. Accordingly the bulk and weight of the unit should be as low as possible compatible with safety.

With these considerations a unit of the tear webbing type is envisaged with a stitch rupture occurring at a threshold of 2.5 KN to 3.5 KN and preferably say 3 KN. Such a unit can be extensible for 0.5 to 1.0 meter in dependence upon the severity of the shock load being cushioned. It will be appreciated that due to the presence of the rewind spring, the safety line will normally be maintained taut without slack. In such circumstances a fall arrest through a distance of 0.5 to 1.0 meter is considered acceptable and likely to avoid contribution to injury to the faller.

Figure 2:
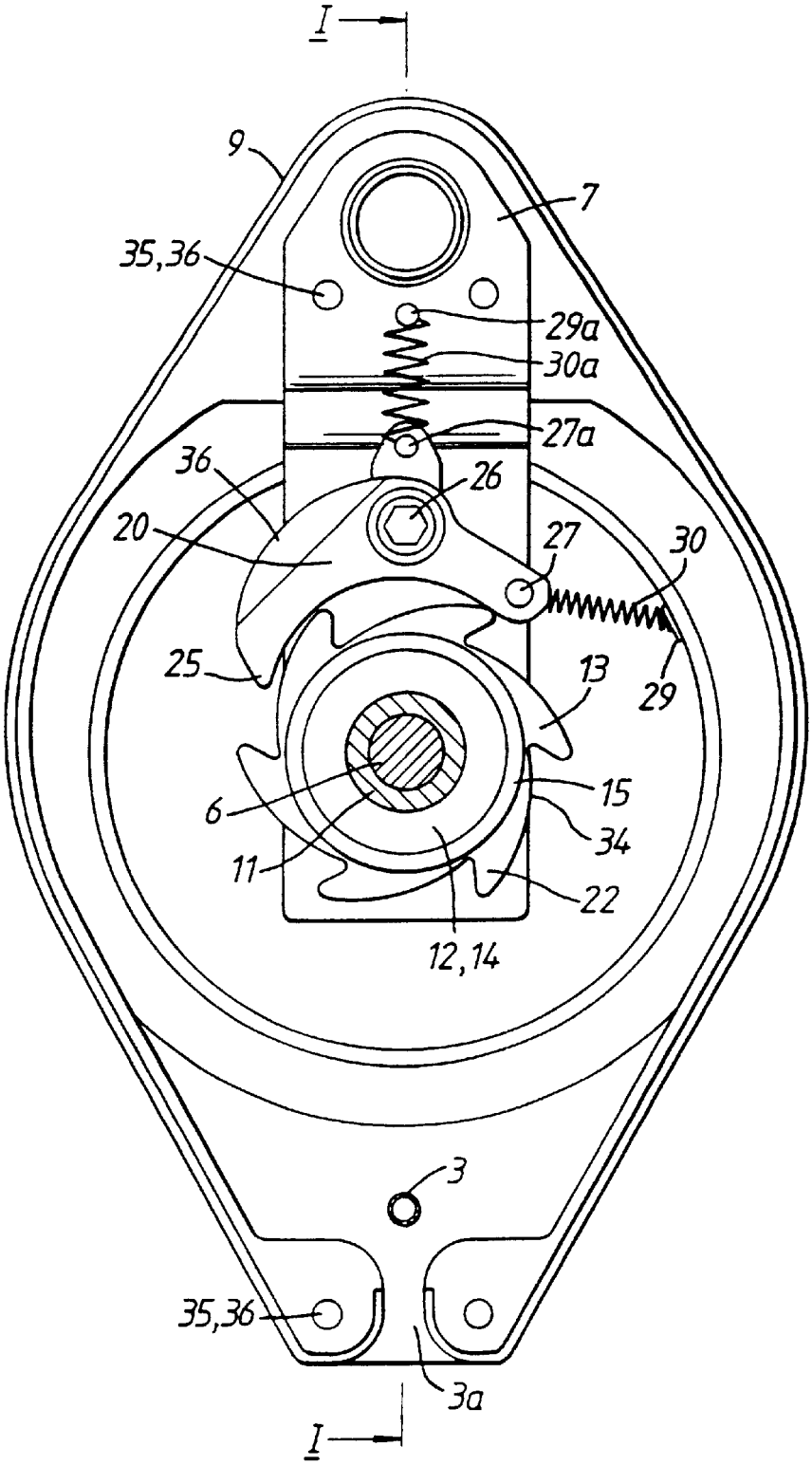

Preferred embodiments of fall arrest apparatus incorporating a speed responsive coupling device according to the invention will now be described by way of example only and with reference to the accompanying drawings, in which;

FIG. 1 is a cross-sectional end view of the fall arrest apparatus according to a first embodiment of the invention, taken on the line I—I of FIG. 2, which is a cross-sectional side view taken on the line II—II of FIG. 1.

Figure 3A:
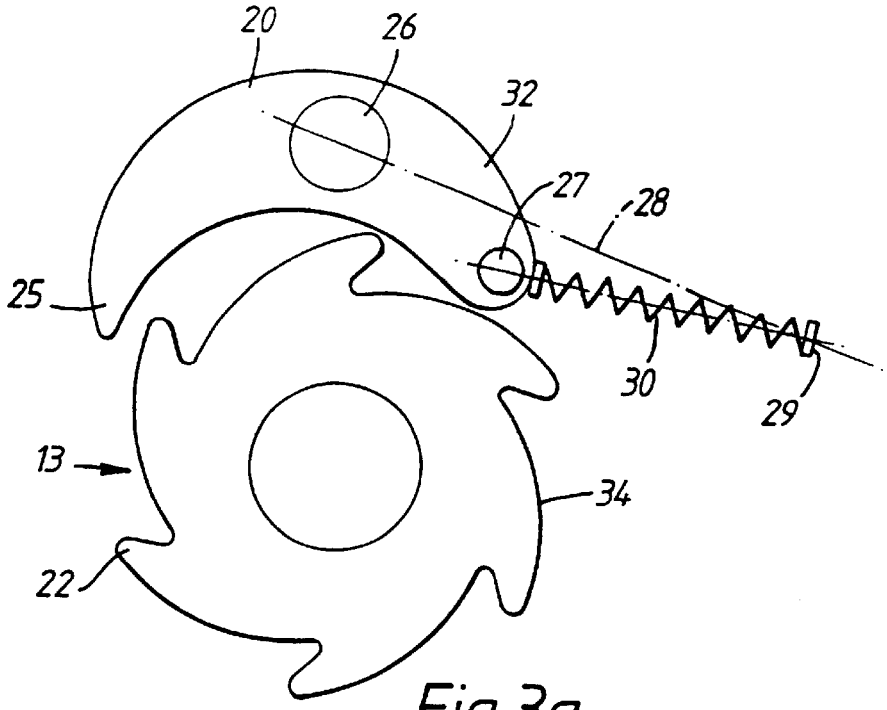
Figure 3B:
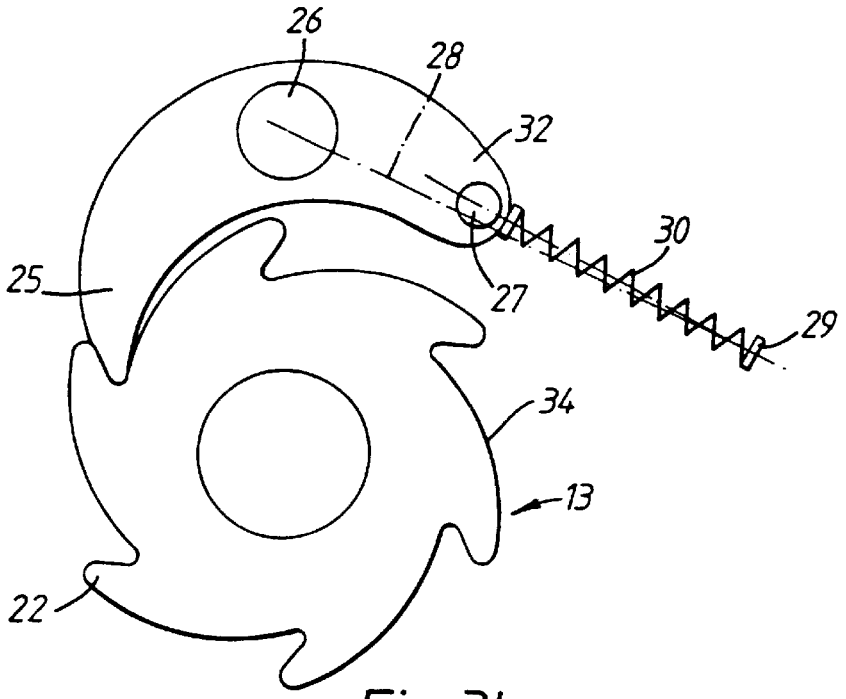
Figure 4:
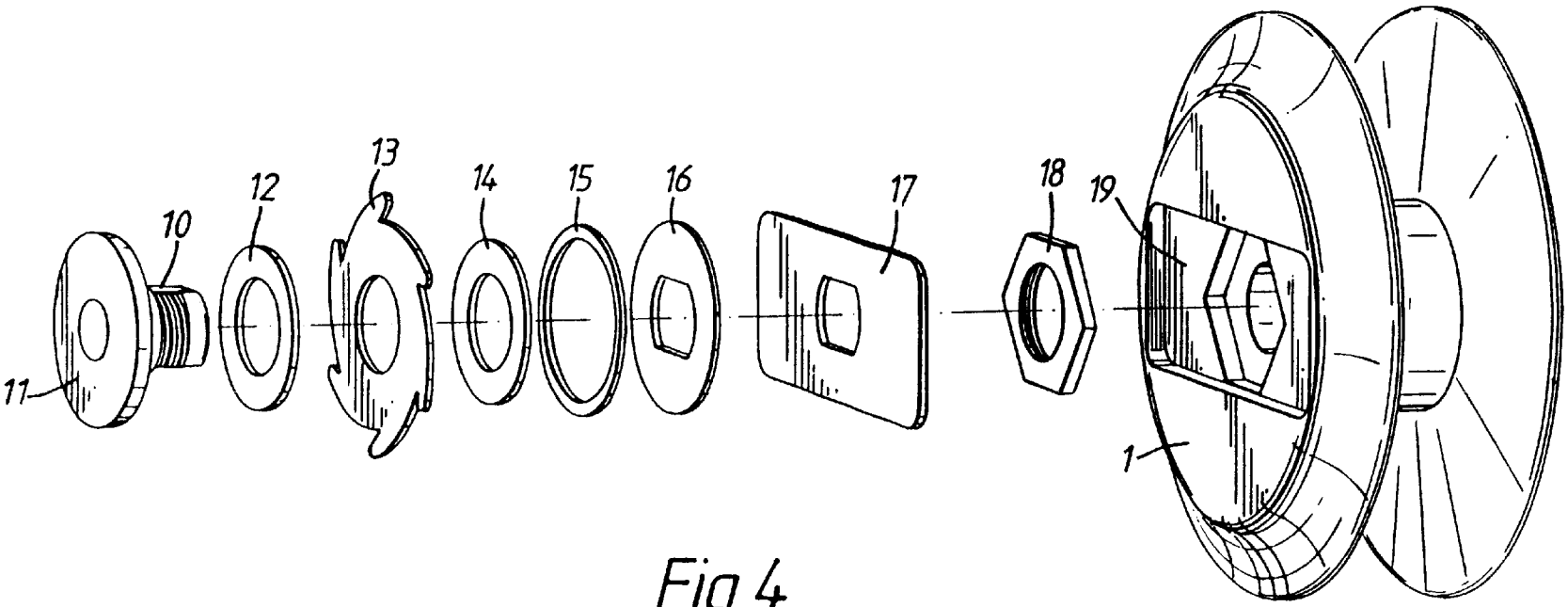

FIGS. 3*a* and 3*b* are diagrammatic views showing the operation of a pawl arranged as a mechanical toggle switch for engaging a toothed ratchet wheel; and FIG. 4 is an exploded view showing a toothed ratchet wheel and the components of a braking assembly.

Figure 5:
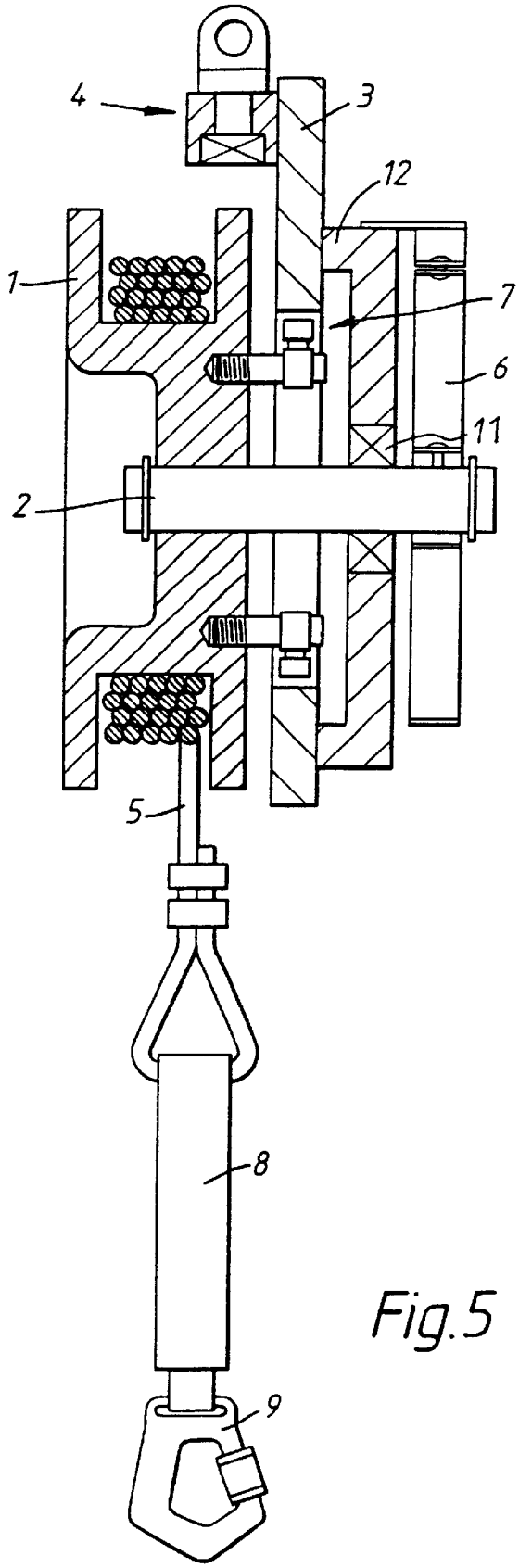

FIG. 5 illustrates a second embodiment of the invention which, in contrast to the first described embodiment, has no braking means.

Reference will be made first to FIGS. 1 and 2 of the drawings. The fall arrest apparatus which is here shown, includes a drum 1 on which is wound a safety line which can be paid out with the drum unwinding relative to a drum housing generally designated 2 against the bias of a coiled spring 4, and includes braking means generally designated 5 for retarding the rotation of the drum if a threshold unwinding speed is exceeded, said braking means being brought into operation to effect such braking of the drum by the speed responsive coupling device of the invention.

The drum 1 together with its braking components are advantageously carried for rotation on a common shaft 6 which is supported on an anchor member constituted a metal stirrup 7 having an anchor point, conveniently in the form of a through hole 8, by which it may be secured to a fixed anchorage, on for example a building or other civil engineering structure such as a bridge or tower.

According to a preferred feature of the invention, the apparatus is afforded electrical insulating properties, and to this end, the drum 1, its shaft 6 and the supporting stirrup 7 are encased in a housing cover 9 of electrically insulating material, so that there are no metal parts at the external surfaces of the apparatus. To this end also the safety line wound on the drum, may be constituted by an elongate strip of webbing of non-conductive material such a woven polyester fiber. As is usual the safety line will have one end tethered to the drum and the line will emerge from the apparatus past a guide bar 3 and an exit slot 3*a*.

The housing cover 9 is in two parts secured together by fixing screws 35 the heads of which are preferably masked by plugs of insulating material. Securing together of the two parts of the housing cover 9 will be effective to fix in proper location, in apertures 7*a* of the stirrup 7, the two ends of the shaft 6 having the drum 1 and the braking means 5 pre-assembled thereon.

In the embodiment of the invention illustrated in FIGS. 1 to 4, the apparatus is provided with braking means 5 which are brought into operation automatically to brake the rotation of the safety line drum 1 if a threshold unwinding speed is reached. In the embodiment shown in FIG. 5 there is no such braking means.

As will be seen in greater detail in FIG. 4, the braking means comprise friction discs 12 and 14 which are permanently carried by and rotate with the drum 1 and such pads or discs bear upon a reaction member 13 which at normal unwinding speeds rotates with the drum 1.

However, due to the presence and operation of the speed responsive coupling device of the invention, at a speed exceeding a threshold unwinding speed, this reaction member 13 becomes locked against rotation in the direction of unwinding of the safety line, and thereupon continued rotation of the drum 1 relative to the housing 2 is frictionally resisted and retarded by the braking discs 12 and 14 frictionally engaging between elements fast with the rotating drum 1 and the now fixed reaction member 13.

In the device illustrated, the reaction member is a wheel 13 which is located between the friction discs 12 and 14. These elements are carried for rotation on the cylindrical shank of a hollow bolt 11. The bolt 11 has a key flat 10 on which is located a washer 16 and a dog plate 17 secured by a nut 18. The bolt 11 is fitted over one end of the shaft 6 with the dog plate 17 and the nut 18 being received in a recess 19 in the side of the drum 1. Advantageously but not essentially, the disc 12 may be housed within a recess in the head of the bolt 11 such that the disc is confined within a surrounding rim. The disc 14 is also confined within a surrounding rim constituted by a washer 15. The thicknesses of the discs 12 and 14 and the thicknesses of their confining rims is so adjusted that when the components are assembled, and the bolt 11 is screwed fully home of the nut 18, the discs 12 and 14 are pre-compressed to a threshold extent, such as to give such frictional braking resistance as may be required to relative rotation of the parts.

The bolt 11 together with the components which it caries normally rotate on the shaft 6 together with the drum 1. However, and as will be described below, a speed responsive coupling device is provided for preventing rotation of the wheel 13 in one direction of rotation when the speed of drum rotation exceeds a threshold speed, and when this occurs, relative rotation between the wheel 13 and the drum 1 is permitted but frictionally resisted by the engagement of the friction discs 12 and 13.

The speed responsive coupling device which is at the heart of this invention will now be described with reference to one embodiment thereof, particularly as shown diagramatically, in the free condition, and in the locked condition, in FIGS. 3*a* and 3*b* respectively.

In the embodiment of speed responsive coupling device according to the invention illustrated in the drawings, the wheel 13 is provided with peripheral teeth 22 to form a ratchet which is engageable by a pawl member 20. The pawl member 20 has a nose portion 25 for engaging the ratchet wheel 13 when it is in the lock condition as shown in FIG. 3*b*. The pawl is carried pivotally on a pin 26 which is fast to the anchor stirrup 7. The pawl 20 and its pivot pin 26 will be made of high quality materials and to high engineering standards.

The pawl member 20 also has a tail or rocker portion 32, and it carries a mounting 27 for one end of a compression spring 30. The other end of the compression spring 30 is attached to a fixed mounting point 29 carried by the anchor stirrup 7. A notional line 28 joins the axis of the pivot pin 26 with that mounting point 29.

The arrangement is such that when the pawl 20 is in the free condition as shown in FIG. 3*a*, the spring attachment point 27 on the pawl member lies on one side of that notional line 28, and accordingly, the compression spring acts to produce a clockwise turning moment on the pawl member retaining its nose portion 25 out of engagement with the toothed ratchet wheel 13. As the ratchet wheel 13 rotates slowly in the clockwise direction in FIG. 3, corresponding to unwinding of safety line from the drum 1, successive teeth 22 of the ratchet wheel 13 bear against the rocker portion 32 of the pawl member 20 and thus cause the pawl to rock on its pivot pin 26. However, because of the clockwise turning moment exerted on the pawl member by the toggle bias spring 30, that rocker portion 32 will be urged to follow the ratchet wheel profile and the pawl member 20 will oscillate or rock about its pivot 26 in a quasi-stable condition in which the ratchet wheel is free to rotate.

If the speed of the rotation of the ratchet wheel 13 exceeds a certain threshold value, the teeth 22 will strike the rocker portion 32 with increased severity such that the momentum imparted to the pawl member 20 during its rocking movement will be sufficient to carry the toggle bias spring attachment point 27 on the pawl 20 past a metastable state where it lies on the notional line 28, so that the pawl is now totally unstable and flips over into the lock condition, in which it is shown in FIG. 3*b*. In that position, the spring attachment point 27 on the pawl member lies on the other side of that notional line 28, and accordingly, the compression spring 30 now acts to produce an anti-clockwise turning moment on the pawl member 20 urging its nose portion 25 into engagement with the toothed ratchet wheel 13.

It will be noted that the pawl teeth 22 are also provided with camming surfaces 34 and when the pawl abutment nose 25 is engaged between ratchet teeth 22, it also bears on one of these pawl tooth cam surfaces 34. The arrangement is such that, as soon as the pull on the drum 1 in the unwinding direction ceases or becomes sufficiently reduced, the line rewinding spring will operate to rotate the drum in the direction of rewind (which is anti-clockwise in FIGS. 2, 3*a* and 3*b* of the drawings), and when this occurs, the abutment nose 25 of the pawl will ride along the tooth cam surface 34 on which it bears until the pawl 20 is caused to rock to such an extent that it reaches its metastable state and then flips back from its lock condition (FIG. 3*b*) to its free condition (FIG. 3*a*), again under the influence of the compression spring 30.

It will be appreciated that the change of state of the pawl will be determined by a number of factors such as the rotational speed of the drum 1, the strength of the toggle spring 30, the geometry of the arrangement generally and the mass of the pawl 20 itself. A region of the pawl 20 where mass may be added or removed to effect tuning or adjustment in these respects is indicated at 36 . And it will be appreciated that the toggle spring arrangement need not be as shown in FIGS. 3 where the toggle spring is connected to the rocker portion 32 of the pawl. Instead the toggle spring could be arranged to act on any convenient part of the pawl, for example as indicated in FIG. 2 at 30*a* between an abutment 29*a* on the stirrup 7 and a fixture point 27*a* located on a part of the pawl extending above its pivot pin 26. Any other toggle system where the pawl is spring urged and rocks between two stable or quasi-stable conditions by way of an intermediate metastable state may be employed.

The employment of the mechanical toggle and cam mechanism as above described has certain advantages as compared with the clutch mechanisms utilising centrifugal force which hitherto have been almost universally employed. When such a mechanical toggle and cam mechanism is properly deployed, it will be seen to have great sensitivity to drum unwinding speed so as to enable an acute differentiation to be made between withdrawal of the safety line during normal unwinding as compared with the unwinding at a higher rate such as occurs in the event of a fall. The mechanism can be arranged and set up so that the pawl locks with the ratchet teeth as soon as the drum accelerates past a given threshold; and indeed this locking effect is achieved virtually instantaneously when that critical threshold is reached. In a fall situation such a high speed of reaction at the onset of the fall prevents the safety line from being paid out, save to a minimal extent; and as the fall is arrested very early, high forces and speeds are not allowed to build and high shock loadings are obviated.

The coupling device now proposed also gives the possibility of a saving of weight so far as concerns the rotating parts since the pawl or pawls is/are carried on a non-rotating component. Also, since during use the pawl is always oscillating, the risk of impaired performance due to adverse effects caused for example by dirt, damp or temperature, is reduced.

The teeth 22 of the reaction wheel 13 are preferably so cut that the nose portion 25 of the pawl member 20 engages deeply behind a tooth 22 when the pawl 20 is in the engaged condition as shown in FIG. 3*b*. In order for the pawl to become disengaged so that it can adopt its free condition it is necessary for the wheel 13 to be partially rotated in the re-wind direction, that is the anti-clockwise direction in FIG. 3*b*, through at least 5° and preferably about 10° of rotation, before the nose portion 25 can be disengaged from behind a tooth as is necessary to enable the pawl to rock to its free condition. This is a highly advantageous feature, since the safety line mounted on the drum 1 must be given some slack before such partial rotation of the wheel 13 in the re-wind direction can take place; and the provision of such slack can only be provided when the worker supported by the safety line has reached a safe and stable condition. In effect this feature reduces the risk of the worker being placed in further jeopardy due to unwanted payout of the safety line subsequent to initial arrest of a fall.

Reference will now be made to the embodiment of the invention shown in FIG. 5. The reference numerals used for FIG. 5 are unique to that figure.

Referring to FIG. 5, the fall arrest apparatus here shown comprises a line drum 1 supported by a shaft 2 for rotation relative to a rigid plate member 3 adapted to be secured to a fixed anchorage, for example with an intervening swivel 4. The shaft 2 rotates in a bearing 11 housed in a rigid casing 12 which is fast with the plate 3.

A safety line 5 is wound on the drum 1 and which can be paid out with the drum unwinding against the influence of a rewind coil spring 6. The inner end of the coil spring 6 is attached to the shaft 2 and the outer end of the spring 6 is attached to the casing 12.

An unwind rotational speed sensitive clutch means generally designated 7 is operable between the rigid plate member 3 and the drum 1, and is effective to stop rotation of the drum relative to the rigid plate member when a predetermined speed of drum rotation is reached.

The safety line 5 incorporates at or towards its outboard end, an energy dissipating unit generally designated 8 for cushioning shock loads occasioned by the safety line. The energy dissipating unit 8 is so connected in the safety line 5 that it can only be disconnected by such destructive breaking of the connection as to render the connection non-reusable.

For example the line 5 terminates in a loop secured by binding which can only be undone by destructive severance. Similarly the unit 8 is secured to a metal hook member 9 and the connection therebetween is such that it can only be unmade by destructive cutting or shearing.

The energy dissipating unit 8 is preferably of the tear webbing type which is per se well known. In this a length of webbing is stitched in folds and when shock occurs the stitches rupture to allow the folded webbing to unfold. Such devices can be set to operate at a specified threshold; that is the stitches begin to rupture at a predetermined shock loading such as 3 or 6 KN. The maximum extensibility of such a device can be predetermined. A typical maximum extensibility is 1 meter.

The clutch mechanism 7 is a speed sensitive coupling device incorporating a toggle type spring biassed pawl and ratchet arrangement as described above with reference to FIGS. 1 to 4.

With appropriate choice of components, design and testing, such a clutch mechanism shown can be rendered very sensitive and lock up can be ensured when a predetermined speed of drum rotation is exceeded; while on the other hand, at lower speeds, drum rotation in normal payout and rewind speeds is freely permitted. Also, while this embodiment of the invention provides a device wherewith line payout can be interrupted abruptly whenever a predetermined payout speed is exceeded and thus predetermination of lock up speed can be set with accuracy, moreover, once lock up occurs, the tear-webbing type of energy dissipating unit used for shock cushioning has the advantage that its maximum extensibility is known. Accordingly a fall arrest mechanism with fully predictable performance is obtained.

Because the fall arrest mechanism now proposed and as shown in FIG. 5, has no braking mechanism, in the event of a fall, reliance is placed exclusively upon the energy dissipating unit 8, to provide cushioning, and accordingly it is vital that the unit 8 is made inseparable from the line 5. In this way it is not possible to make use of the line and drum with its clutch mechanism without the unit 8 being present and in good operative condition. Removal of the unit 8 is only possible by destructive severance of its connections. If the unit 8 is of the webbing type it breaks open when used, giving a clear indication of such use. There is therefore little likelihood of inadvertent reuse which might involve risk. The intention is that the device now proposed should be used once only, and that it is replaced after such single use.

Although the energy dissipating unit 8 inseparably incorporated in the fall apparatus of the present invention, is preferably of the above described tear webbing type, other types of energy dissipating unit can be employed instead, provided that they are incorporated by means of connections which can only be unmade by destructive severance.

Also as above described the drum 1 is supported by the shaft 2 for rotation relative to a rigid plate member 3 by means of a bearing 11 in a casing 12 fast with the plate 3. However, in apparatus according to the invention, instead of the plate 3 with its casing 12, there could be substituted a rigid housing. In this case, the drum 1 would be located within the housing and the shaft 2 could have its opposite ends supported by bearings fixed to the housing walls.

As a further alternative, the fall arrest apparatus according to the invention could be provided with a manually operable winch mechanism with the aid of which the line drum could be wound or unwound. For example such a winch might be employed to lower a fallen worker to a platform or to the ground.

What is claimed is:

1. A speed responsive coupling device for locking a first member with respect to a second against relative rotation in at least one direction, which device comprises a ratchet wheel carried by said first member which is engageable by a pawl carried by the second member, characterised in that said pawl is arranged as a mechanical toggle switch which is biased to assume and remain in either of a "free" condition in which such relative rotation is permitted and a "lock" condition in which the pawl engages the ratchet wheel to disallow such relative rotation, said pawl being linked to a rocker which is so shaped and disposed that when the pawl is in the free condition, such relative rotation causes the rocker to rock and that when the speed of such relative rotation exceeds a threshold value, the strength of the rocking motion imparted causes the rocker to flip the pawl to the lock condition.

2. A device according to claim 1, wherein said rocker is an integral part of the pawl.

3. A device according to claim 1, wherein the arrangement is such that during such relative rotation, the ratchet wheel bears directly against said rocker.

4. A device according to claim 1, wherein said first member comprises a drum on which a line may be wound.

5. A device according to claim 1, wherein said first and second members are lockable against such relative rotation in one direction only ("the unwinding direction"), and said rocker is so shaped and disposed that when the pawl is in the lock condition, relative rotation in an opposite, winding, direction causes the pawl to flip back to the free condition.

6. A device according to claim 1, wherein said first and second are lockable against such relative rotation in one direction only ("the unwinding direction"), and spring means is provided to urge relative rotation of said first and second members in an opposite, winding, direction.

7. A device according to claim 4, wherein said drum is rotatable with respect to an anchor member by means of which the drum may be anchored to a fixed structure.

8. A device according to claim 7, wherein said pawl and ratchet are operable to lock said drum against rotation relative to a braking member which is in braking engagement with said ratchet.

9. A device according to claim 7, wherein said pawl and ratchet are operable to lock a braking member which is in braking engagement with said drum against rotation relative to said anchor member.

10. A device according to claim 7, wherein said pawl and ratchet are operable to lock said drum against rotation relative to said anchor member.

11. A device according to claim 1 and wherein said pawl is subjected to compression spring bias by an over-center toggle spring arrangement so that the pawl flips between its two quasi-stable operative conditions and so that the pawl is unstable except when in one of its two operative conditions.

12. A device according to claim 1 and wherein the pawl is pivotally mounted on said second member and said ratchet wheel is mounted on the first member, said second member being fixed and said first member being mounted for rotation relative to the second member and wherein said ratchet wheel has teeth which, during rotation of the first member, run over a cam surface of the pawl to cause the pawl to rock and oscillate while being maintained in said free condition, said pawl oscillating in said free condition, except when at a predetermined threshold speed of rotation of said ratchet wheel, the amplitude of the rocking motion imparted to the pawl increases sufficiently to cause the pawl as it rocks to traverse a metastable condition and reach its lock condition.

13. Fall arrest apparatus comprising a device according to a claim 1, wherein said second member is an anchor member, and said first member is a drum rotatably connected to said anchor member; and a safety line wound about said drum, wherein said drum is locked against rotation in a line unwinding direction in the event that said line is being stripped from said drum at a rate which is greater than a threshold value.

14. Fall arrest apparatus according to claim 13 and further characterized in that said safety line incorporates proximate its outboard end, an energy dissipating unit for cushioning shock loads occasioned by the safety line, said energy dissipating unit being so connected in the safety line that it can only be disconnected by such destructive breaking of the connection as to render the connection non-reusable.

15. Fall arrest apparatus comprising a device according to claim 1, wherein said second member is a rigid plate member adapted to be secured to a fixed anchorage, and said first member is a line drum supported by a shaft for rotation relative to said rigid plate member, and further comprising a safety line wound on the drum and which can be paid out with the drum unwinding against the influence of a rewind coil spring, said device being effective to stop rotation of the drum relative to the rigid plate member when a predetermined threshold speed of drum rotation is reached.

16. Apparatus according to claim 15 and further characterized in that said safety line incorporates proximate its outboard end, an energy dissipating unit for cushioning shock loads occasioned by the safety line, said energy dissipating unit being so connected in the safety line that it can only be disconnected by such destructive breaking of the connection as to render the connection non-reusable.

17. A speed responsive coupling device of the type which selectively locks a first member against rotation in at least one direction relative to a second member, comprising:

a ratchet wheel secured to the first member;

a pawl mounted on the second member and movable relative thereto between a first position, wherein the ratchet wheel remains free to rotate in the one direction relative to the pawl and the second member, and a second position, wherein the ratchet wheel is locked against rotation in the one direction relative to the pawl and the second member, wherein the pawl includes a nose portion, a tail portion, and an intermediate portion disposed therebetween, and the intermediate portion is rotatably mounted to the second member; and a resilient member and interconnected between the pawl and the second member in such a manner that the resilient member biases the pawl to remain in the first position and also biases the pawl to remain in the second position, wherein the tail portion bears against the ratchet wheel as the ratchet wheel rotates in the one direction relative to the pawl and the second member, and when the ratchet wheel rotates at sufficient speed, its impact against the tail portion overcomes the bias of the resilient member and causes the nose portion to bear against the ratchet wheel.

18. A fall arrest apparatus, comprising:

a base;

a drum rotatably mounted on the base;

a safety line wound about the drum;

a locking means, interconnected between the base and the drum, for selectively locking the drum against rotation in at least one direction relative to the base; and a toggled biasing means, interconnected between the base and the locking means, for biasing the locking means to remain in an unlocked position, and for biasing the locking member to remain in a locked position.

19. The apparatus of claim 18, wherein the biasing means includes a helical coil spring compressed between the base and the locking means.

20. The apparatus of claim 18, wherein the locking means includes:

a ratchet wheel secured to the drum; and a pawl mounted on the base and movable relative thereto between a first position, wherein the ratchet wheel remains free to rotate in the one direction relative to the pawl and the base, and a second position, wherein the ratchet wheel is locked against rotation in the one direction relative to the pawl and the base.

21. The apparatus of claim 20, wherein the biasing means includes a helical coil spring compressed between the base and the pawl.

22. The apparatus of claim 18, further comprising an energy dissipating member connected in series with the safety line.

23. A fall arrest apparatus, comprising:

a base;

a drum rotatably mounted on the base;

a safety line wound about the drum;

a braking means, interconnected between the base and the drum, for selectively resisting rotation of the drum in at least one direction relative to the base; and a toggled biasing means, interconnected between the base and the braking means, for biasing the braking means to remain in an inoperative condition, and for biasing the braking means to remain in an operative condition.

24. The apparatus of claim 23, wherein the biasing means includes a helical coil spring compressed between the base and the braking means.

25. The apparatus of claim 23, the braking means including:

a ratchet wheel secured to the drum with at least one friction disc disposed therebetween; and a pawl mounted on the base and movable relative thereto between a first position, wherein the ratchet wheel remains free to rotate in the one direction relative to the pawl and the base, and a second position, wherein the ratchet wheel is locked against rotation in the one direction relative to the pawl and the base.

26. The apparatus of claim 25, wherein the biasing means includes a helical coil spring compressed between the base and the pawl.

* * * * *

UNITED STATES PATENT AND TRADEMARK OFFICE

CERTIFICATE OF CORRECTION

PATENT NO. : 6,279,682 B1
DATED : August 28, 2001
INVENTOR(S) : Leonard John Feathers It is certified that error appears in the above-identified patent and that said Letters Patent is hereby corrected as shown below:

Column 10,
Line 28, insert -- members -- after "second".

Signed and Sealed this

Twenty-sixth Day of February, 2002

*Attest:*

*Attesting Officer*

JAMES E. ROGAN
*Director of the United States Patent and Trademark Office*